US012582285B2

(12) United States Patent
Gregory et al.

(10) Patent No.: US 12,582,285 B2
(45) Date of Patent: Mar. 24, 2026

(54) TREATING CHEMISTRY CARTRIDGE FOR A HOUSEHOLD APPLIANCE

(71) Applicant: WHIRLPOOL CORPORATION, Benton Harbor, MI (US)

(72) Inventors: Joseph Allen Gregory, Niles, MI (US); Elliott Vernon Stowe, Stevensville, MI (US); Chandler Alexander Longley, Benton Harbor, MI (US); Ameresh B. Viswanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 94 days.

(21) Appl. No.: 18/526,817

(22) Filed: Dec. 1, 2023

(65) Prior Publication Data

US 2025/0176796 A1 Jun. 5, 2025

(51) Int. Cl.
*A47L 15/44* (2006.01)
*A47L 15/42* (2006.01)

(52) U.S. Cl.
CPC ..... *A47L 15/4472* (2013.01); *A47L 15/4217* (2013.01); *A47L 15/4463* (2013.01)

(58) Field of Classification Search
None
See application file for complete search history.

(56) References Cited

U.S. PATENT DOCUMENTS

| | | | |
|---|---|---|---|
| 6,152,327 | A | 11/2000 | Rhine et al. |
| 7,931,032 | B1 | 4/2011 | Penkauskas et al. |
| 8,980,014 | B2 | 3/2015 | Classen et al. |
| 11,408,112 | B2 | 8/2022 | Lv et al. |
| 2011/0139818 | A1 | 6/2011 | Kessler et al. |
| 2012/0031930 | A1 | 2/2012 | Fileccia et al. |
| 2018/0014715 | A1 | 1/2018 | Heiligenmann et al. |

FOREIGN PATENT DOCUMENTS

| | | | |
|---|---|---|---|
| CN | 204765515 | U | 11/2015 |
| CN | 114667092 | A | 6/2022 |
| DE | 102014210241 | A1 | 12/2015 |
| WO | 2018192457 | A1 | 10/2018 |
| WO | 2023113371 | A1 | 6/2023 |

OTHER PUBLICATIONS

Google Patents translation of DE102014210241A1 (Year: 2025).*
European Patent Office, Extended European Search Report Re: Corresponding Application No. 24214197.6-1015, dated Apr. 4, 2025, 10 pages, Munich, Germany.

* cited by examiner

*Primary Examiner* — Eric W Golightly
(74) *Attorney, Agent, or Firm* — McGarry Bair PC

(57) ABSTRACT

A household appliance, such as dishwasher, includes a treating chemistry cartridge configured to hold multiple unit doses of treating chemistry and dispense the treating chemistry at the appropriate time in a cycle of operation. The treating chemistry cartridge can include a one-way valve and a two-way vent for utilization of treating chemistry cartridge in multiple orientations.

12 Claims, 7 Drawing Sheets

TREATING CHEMISTRY CARTRIDGE FOR A HOUSEHOLD APPLIANCE

BACKGROUND

Contemporary household appliances such as a dishwasher, clothes washer, or clothes dryer, may have one or more cartridges for automatically dispensing one or more treating chemistries at an appropriate time during a cycle of operation. One common type of cartridge is a single use cartridge, which can be filled with only enough treating chemistry (a single "charge" or "dose") for a single cycle of operation. Another common type of cartridge is a bulk cartridge, which may contain enough treating chemistry (multiple charges or multiple doses) for multiple cycles.

BRIEF DESCRIPTION

The disclosure relates to a treating chemistry cartridge for use in a treating chemistry dispensing system of a household appliance, the treating chemistry cartridge comprising: a non-collapsible body defining an interior volume having a liquid treating chemistry portion, for holding a liquid treating chemistry, and a gas portion, for holding a product gas from the liquid treating chemistry; a one-way valve provided in the non-collapsible body and fluidly coupled to the liquid treating chemistry portion; and a two-way vent provided in the non-collapsible body and fluidly coupled to the gas portion.

DETAILED DESCRIPTION

Figure 1:
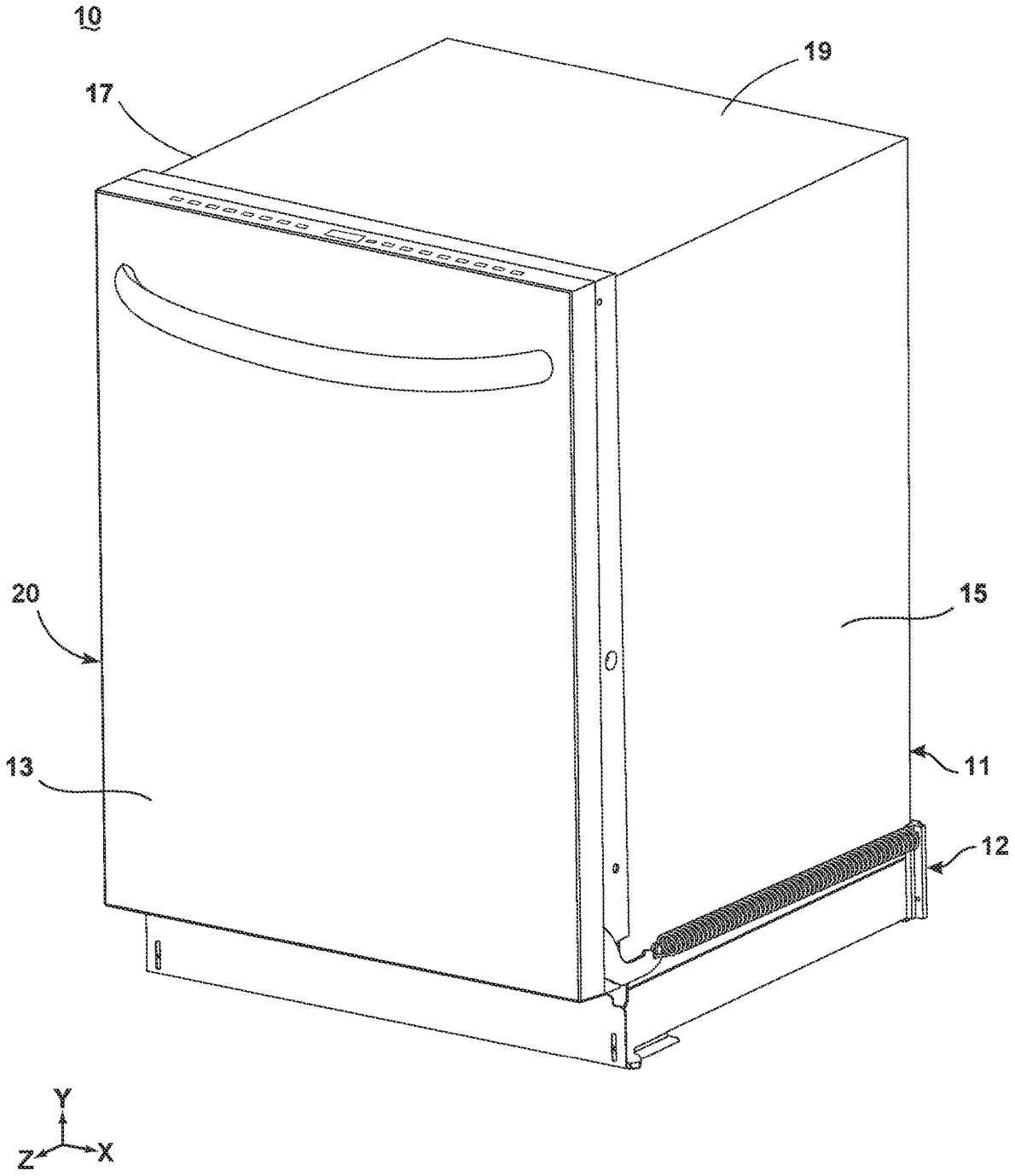
FIG. 1 is a perspective view of a household appliance in the form of a dishwasher with a door assembly closed.

FIG. 1 is an illustration of a household appliance 10, illustrated as a dishwasher 10 herein, with a door assembly 20 closed, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, or other household appliances such as washing machines, having treating chemistry dispensing systems.

The dishwasher 10 has a housing, which may include a cabinet or chassis 11 that may define an interior of the dishwasher 10. Depending on whether the dishwasher 10 is a stand-alone or built-in, the housing of the dishwasher 10 may be a chassis/frame with or without panels attached, respectively. Illustrated, the dishwasher 10 includes the chassis 11 with a base 12 and panels 13, 15, 17, and 19.

Figure 2:
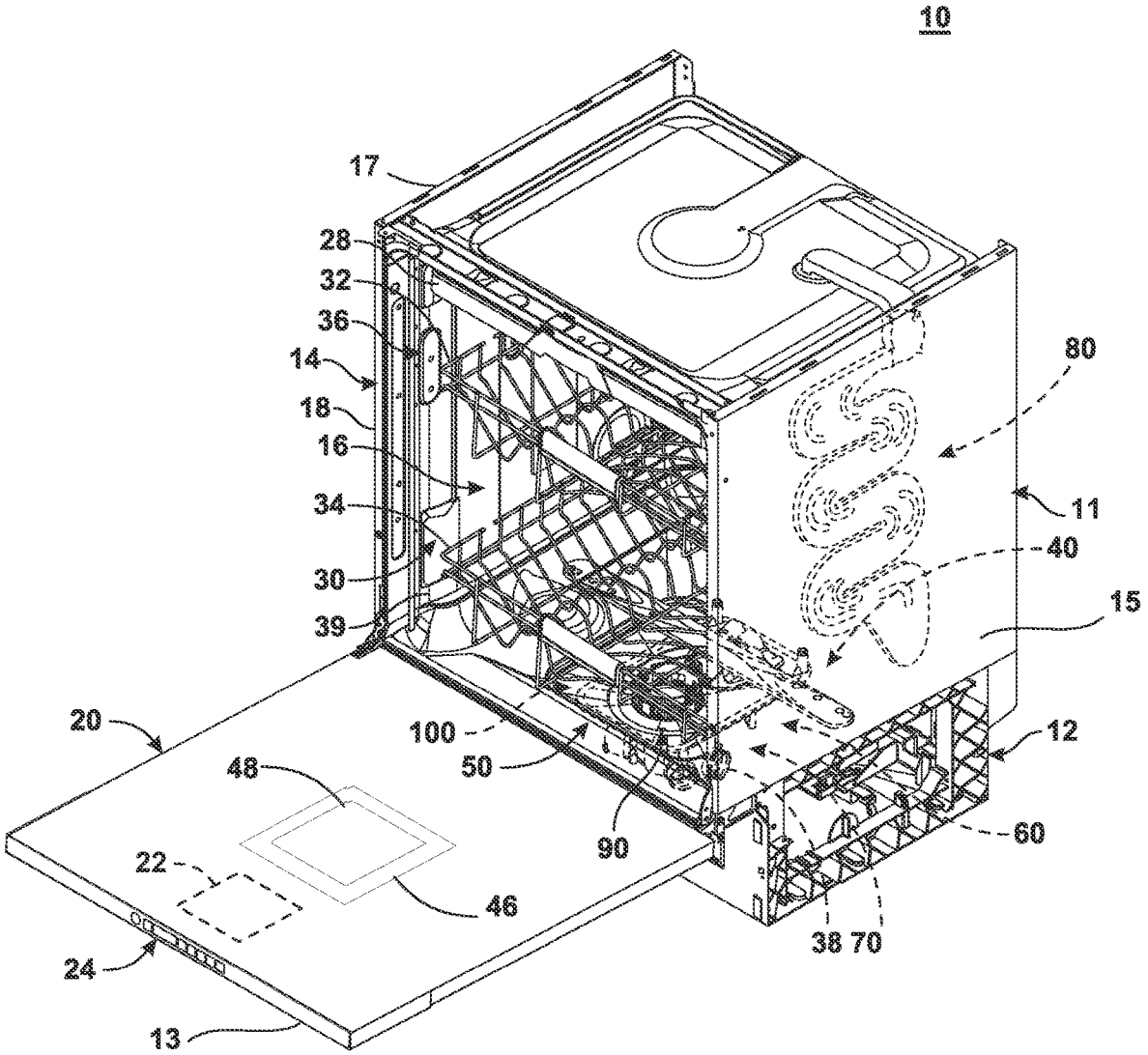
FIG. 2 is a perspective view of the household appliance of FIG. 1 with the door assembly opened, and illustrating multiple systems for implementing an automatic cycle of operation systems.

FIG. 2 illustrates the dishwasher 10 with the door assembly 20 open. The dishwasher 10 has a variety of systems, some of which are controllable, to implement the automatic cycle of operation. The chassis 11 is provided to support the variety of systems needed to implement the automatic cycle of operation. As illustrated, for a built-in implementation, the chassis 11 includes a frame in the form of the base 12 on which is supported a open-faced tub 14, which at least partially defines a treating chamber 16, having an open face 18, for receiving the dishes, and panels 13, 15, and 17. A closure in the form of the door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis 11, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis 11 can be a tub that is slidable relative to a frame, with the closure being a part of the chassis 11 or the countertop of the surrounding cabinetry. In a sink-type implementation, the sink forms the tub and the cover closing the open top of the sink forms the closure. Sink-type implementations are more commonly found in recreational vehicles.

The systems supported by the chassis 11, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phase. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can include the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A treating chemistry dispensing system 46 dispenses treating chemistry, directly or indirectly, into the treating chamber 16. The treating chemistry dispensing system 46 includes a treating chemistry cartridge 48 that is operably coupled to the treating chamber 16 by a conduit (not shown), such that one or more treating chemistries dispensed from the treating chemistry cartridge 48 are supplied to the treating chamber 16. The treating chemistry cartridge 48 can be either or both single-use or bulk sources of treating chemistry. In a bulk-use configuration, the treating chemistry cartridge 48 can be a container that is re-filled by the user and/or a container that is replaced after multiple cycles. While any desired treating chemistries can be dispensed, exemplary types of chemistries that might be dispensed include: detergent, anti-spotting agent, bleach, and enzymes.

Figure 3:
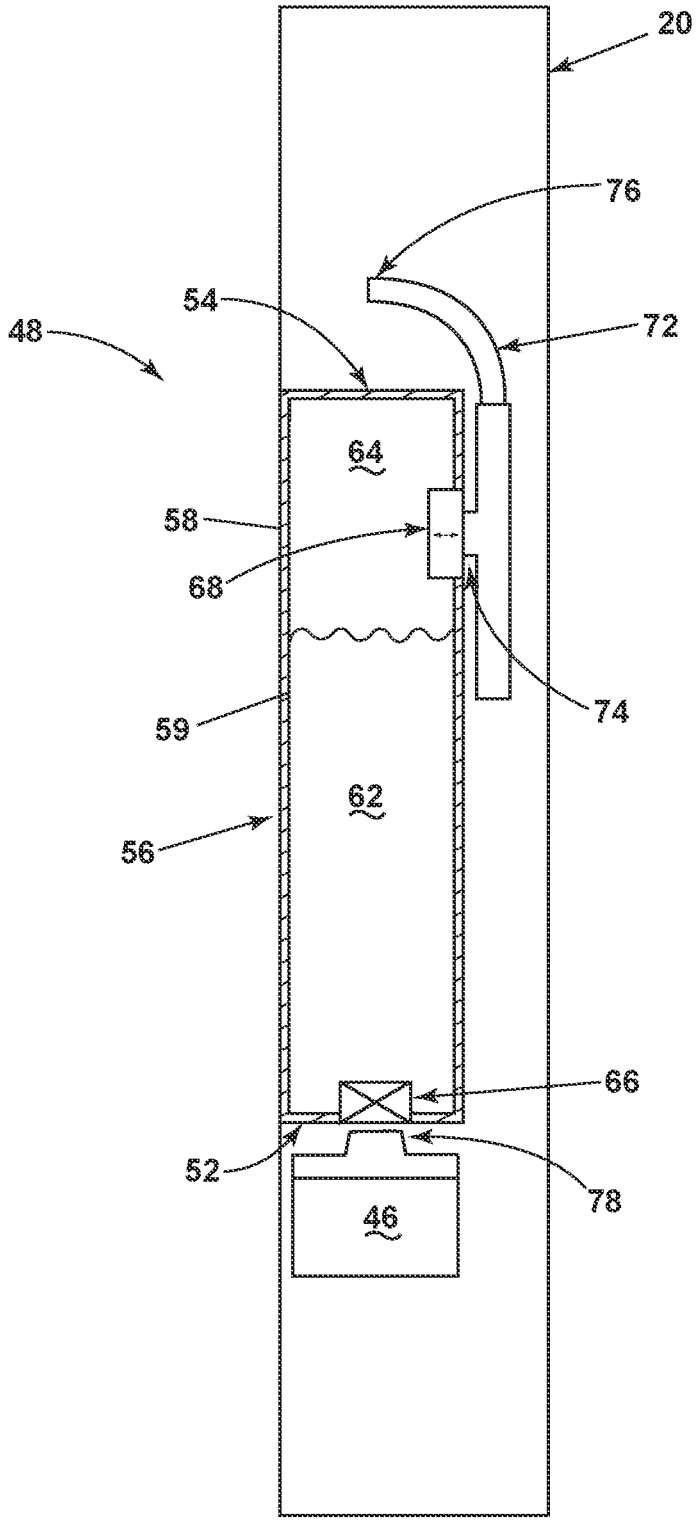
FIG. 3 is a schematic view of a treating chemistry dispensing system with a treating chemistry cartridge mounted in the door assembly of the household appliance of FIG. 1 and FIG. 2.

Referring to FIG. 3, the treating chemistry cartridge 48 and portions of the chemistry dispensing system 46 are shown in greater detail. The treating chemistry cartridge 48 includes a body 58, which is illustrated as a rectangular shape having a bottom wall 52 and top wall 54, with a side wall 56 extending between the bottom wall 52 and the top wall 54, defining an interior volume 59. Alternatively, the treating chemistry cartridge 48 can have any desired shape that can include but is not limited to a rounded or tubular body. Additionally, while the body 58 is illustrated and described as a non-collapsible body, it is possible for the body 58 to be collapsible. The distinction between a collapsible and non-collapsible body is that when liquid is removed from the body 58, a non-collapsible body needs to have the removed liquid replaced with another fluid, such as air, to avoid a low-pressure or vacuum lock, whereas the collapsible body does not.

The interior volume 59 is divided into a liquid treating chemistry portion 62, and a gas portion 64. The liquid treating chemistry portion 62 is defined as a portion of the interior holding liquid treating chemistry. The gas portion 64 can hold gas that is off-gassed as a natural consequence of the liquid chemistry in the liquid treating chemistry portion 62 and/or hold gas, such as air, that is provided to replace chemistry dispensed from the liquid treating chemistry portion 62 to prevent low pressure lock. A one-way valve 66 is provided in the body 58 and fluidly couples the liquid treating chemistry portion 62 to the treating chemistry dispensing system 46. In a non-limiting example, the one-way valve 66 can include a membrane. More specifically, the one-way valve 66 can include a displaceable membrane that can displace to an open or closed configuration.

One configuration for the treating chemistry dispensing system 46 is a pump that can fluidly couple the treating chemistry cartridge 48 to the treating chamber 16. The treating chemistry dispensing system 46 and the treating chemistry cartridge 48 can be mounted on an inner surface of the door assembly 20, as shown, or can be located at other positions within the chassis 11.

A two-way vent 68 is provided in the body 58 and fluidly couples the gas portion 64, directly or indirectly, to ambient or other volume for venting or supply of replacement fluid. As illustrated, the two-way vent 68 is optionally indirectly coupled via a straw 72. In a non-limiting example, the two-way vent 68 can include a membrane. More specifically, the two-way vent 68 can include either or both a gas permeable membrane or a displaceable membrane that can displace to an open or closed configuration.

The straw 72 can be located outside of the body 58, further located within the door assembly 20 having a first opening 74 connected to the two-way vent 68, and second opening 76 fluidly coupled to ambient within the door assembly 20. In a non-limiting example, the straw 72 can have a curved shape, where the first opening 74 is connected to the two-way vent 68 and the second opening 76 can be located above the body 58 following a curve of the straw 72, fluidly coupled to ambient. However, it is contemplated that the straw 72 can have any shape, and the second opening 76 can be located anywhere within the door assembly 20.

The treating chemistry cartridge 48 can be installed to the treating chemistry dispensing system 46 and the straw 72 when the door assembly 20 is open. The treating chemistry dispensing system 46 can include an inlet 78. The treating chemistry cartridge 48 can be inserted to the treating chemistry dispensing system 46, where the liquid treating chemistry portion 62 fluidly couples to the inlet 78, via the one-way valve 66. It is contemplated in a non-limiting example, that the two-way vent 68 can be a displaceable membrane, where the first opening 74 displaces the two-way vent 68 from a closed configuration to an open configuration, fluidly coupling the two-way vent 68 to ambient via the straw 72. Once the treating chemistry cartridge 48 is coupled to the treating chemistry dispensing system 46 and the straw 72, the door assembly 20 can be closed and the dishwasher 10 can be operated.

During operation, the treating chemistry dispensing system 46 may allow for a fractional amount of the entire volume of the treating chemistry cartridge 48 to be dispensed and it may also allow for a specific volume to be dispensed. More specifically, treating chemistry may be drawn out by the treating chemistry dispensing system 46 through the inlet 78 and may then be pumped out of an outlet (not shown) to the environment surrounding the treating chemistry cartridge 48.

Figure 4A:
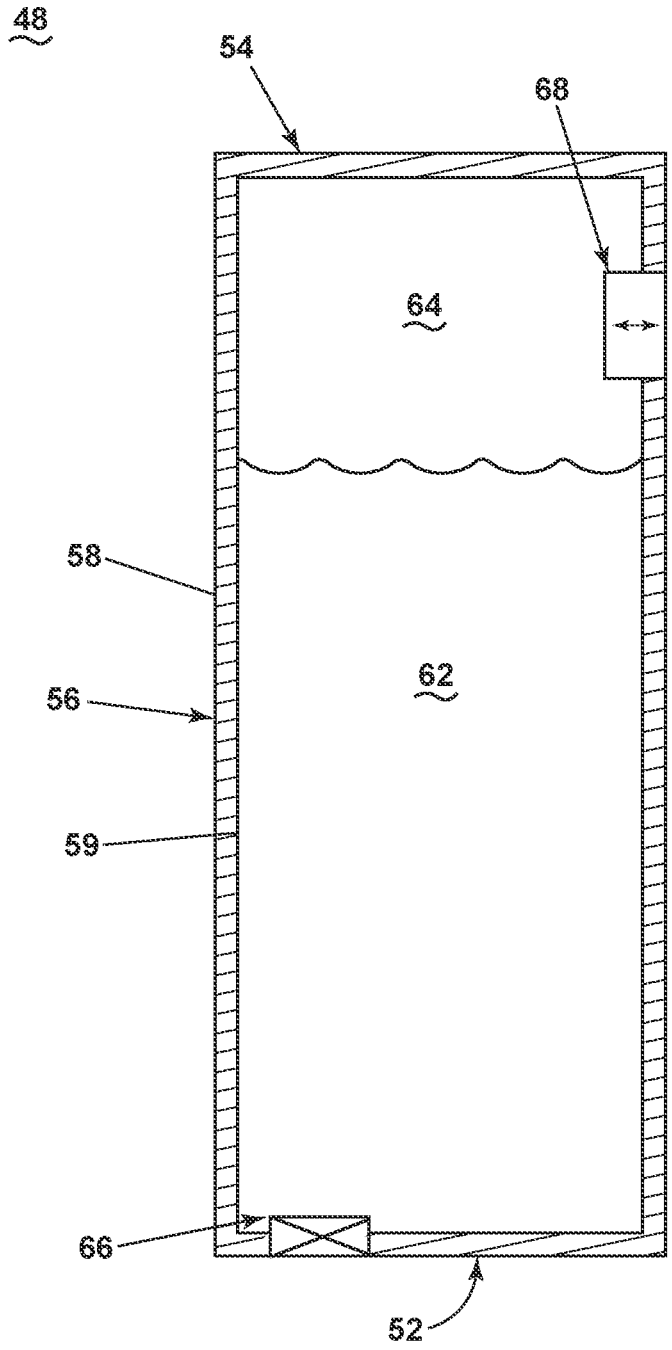
FIG. 4A is the schematic view of the treating chemistry cartridge according to a first embodiment.

FIG. 4A is a schematic view of the treating chemistry cartridge 48 of according to a first embodiment. The one-way valve 66 can be located on the bottom wall 52 in the liquid treating chemistry portion 62, and the two-way vent 68 can be located on a different side from the one-way valve 66, further provided in the side wall 56 in the gas portion 64. The two-way vent 68 fluidly couples the gas portion 64 to ambient.

The treating chemistry cartridge 48 can be configured with two orientations with respect to a vertical axis Y (FIG. 1): a shipping orientation and a use orientation. However, in a non-limiting example, the replaceable treating cartridge 48 can be configured for three orientations with respect to the vertical axis Y (FIG. 1): the shipping orientation, the use orientation, and a loading orientation. During transport or shipping, the treating chemistry cartridge 48 is configured in the shipping orientation, where the treating chemistry cartridge 48 is parallel with respect to the vertical axis Y (FIG. 1). In the shipping orientation, the one-way valve 66 is closed to prevent liquid treating chemistry from escaping or leaking from the treating chemistry cartridge 48. The two-way vent 68 can permit the flow of gas in and out of the gas portion 64, this bi-directional flow of gas prevents gas products from building up within the body 58, subsequently preventing cracks or other damage from causing liquid treating chemistry leaks during transport.

During operation of the dishwasher 10, the treating chemistry cartridge 48 is configured in the use orientation. In the use orientation, the treating chemistry cartridge 48 is oriented the same as the shipping orientation with respect to the vertical axis Y (FIG. 1). However, the one-way valve 66 is open and fluidly coupled to the treating chemistry dispensing system 46 and the two-way vent 68 can be fluidly coupled to ambient. When the liquid treating chemistry is drawn out of treating chemistry cartridge 48 by the treating chemistry dispensing system 46, the volume of liquid treating chemistry is replaced by air vented into the treating chemistry cartridge 48 by the two-way vent 68.

Figure 4B:
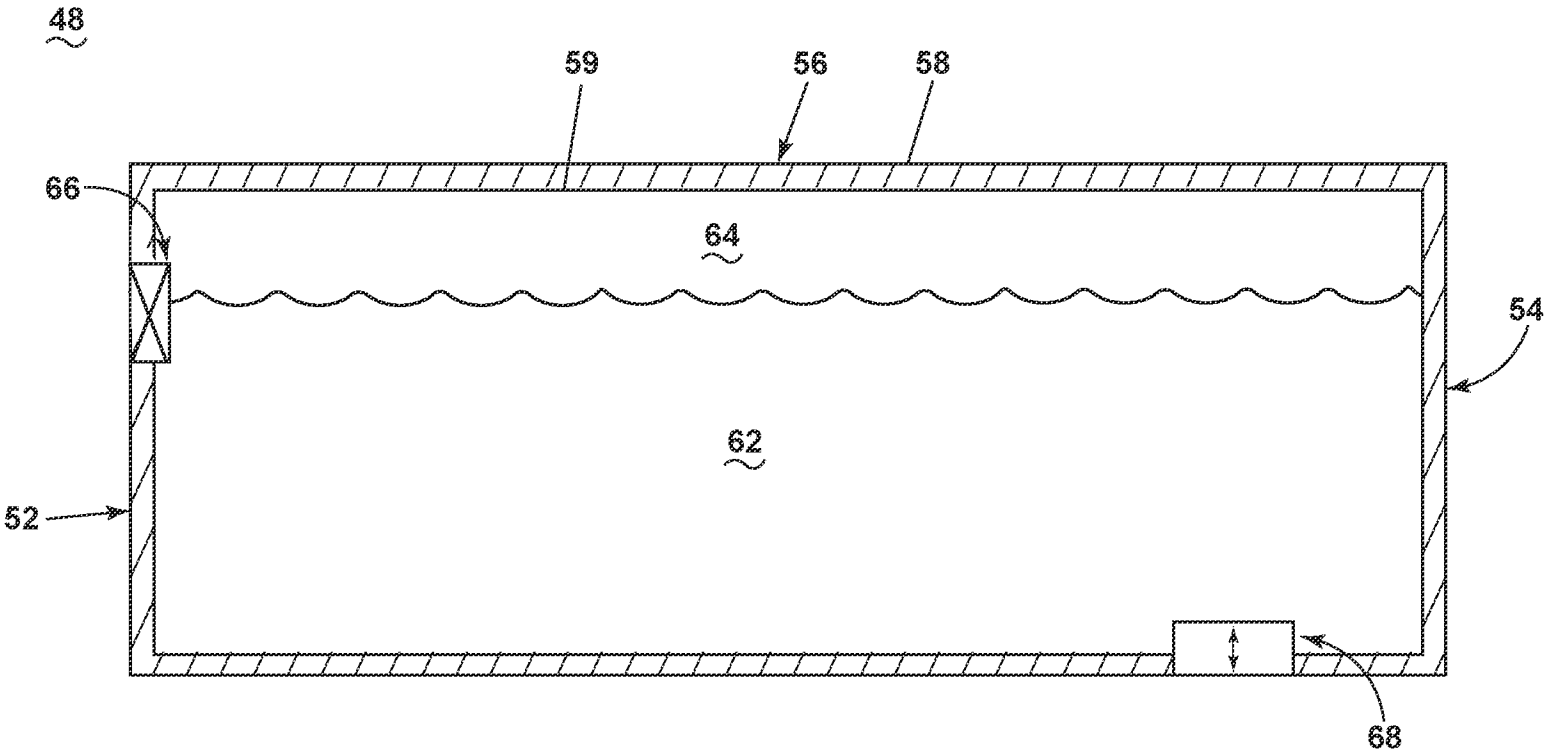
FIG. 4B is a schematic view of the treating chemistry cartridge in a loading orientation, according to a first embodiment.

FIG. 4B is a schematic view of the treating chemistry cartridge 48 in the loading orientation, according to a first embodiment. During article loading, when the dishwasher 10 is loaded with articles for treatment, the door assembly 20 is open and the treating chemistry cartridge 48 is configured in the loading orientation which is oriented about 90 degrees different from the use orientation with respect to the vertical axis Y (FIG. 1), the one-way valve 66 is open and fluidly coupled to the treating chemistry dispensing system 46, and the two-way vent 68 is fluidly coupled to ambient. Further, the body 58 can be oriented at an angle corresponding to the angle in which the door assembly 20 is opened for article loading. The angle can be any degree between the vertical axis Y and a horizontal axis Z (FIG. 1). It is contemplated in a non-limiting example, that two-way vent 68 can be gas permeable membrane, where the two-way vent 68 can permit the flow of gas in and out of the treating chemistry cartridge 48. This bi-directional flow of gas prevents gas products from building up within the body 58 without leaking treating chemistry when the two-way vent 68 is submerged in treating chemistry in the loading orientation.

Figure 5A:
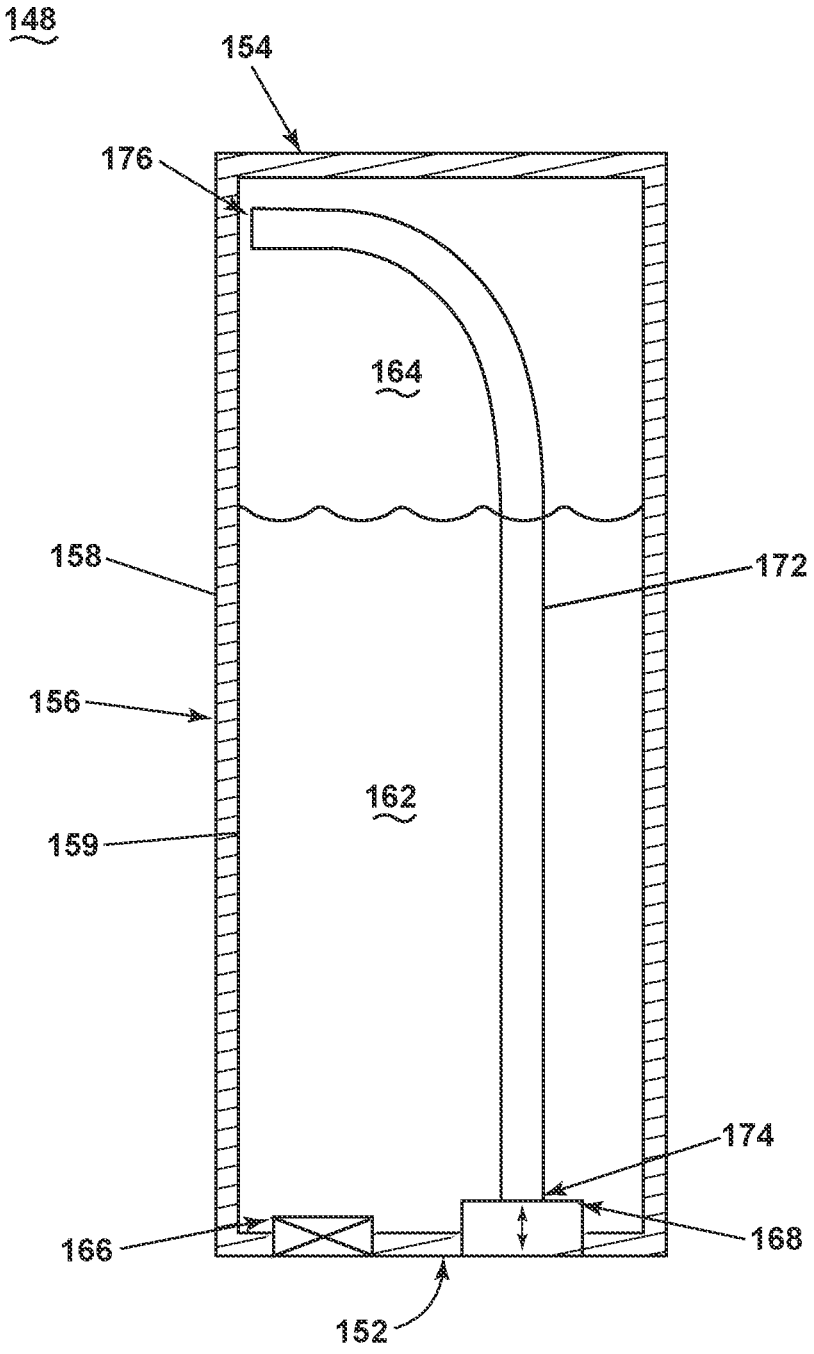
FIG. 5A is the schematic view of the treating chemistry cartridge according to a second embodiment.

FIG. 5A is a schematic view of the treating chemistry cartridge 148 according to a second embodiment. The second embodiment is similar to the first embodiment, however, the one-way valve 166 and two-way vent 168 can be provided on the same side of the body 158, further provided in the bottom wall 152 in the liquid treating chemistry portion 162. It is contemplated in a non-limiting example that the one-way valve 166 and the two-way vent 168 can be located on the top wall 154 or the side wall 156. However, it is further contemplated that the one-way valve 166 and the two-way vent 168 can be located on any wall of the treating chemistry cartridge 148.

The straw 172 can be located in the interior volume 159, having a first opening 174 connected to the two-way vent 168, and second opening 176 located in the gas portion 164, where at least a portion of the straw 172 between the first opening 174 and the second opening 176 passes through the liquid treating chemistry portion 162. The straw 172 may have a generally curved shape, where the second opening 176 can be located in the gas portion 164 in the shipping, use, or loading orientations. However, it is contemplated that the straw 172 can have any shape, and the second opening 176 can be located anywhere within the gas portion 164.

The treating chemistry cartridge 148 can be configured with two orientations with respect to the vertical axis Y (FIG. 1): a shipping orientation and operation orientation. However, in a non-limiting example, the replaceable treating cartridge 48 can be configured for three orientations with respect to the vertical axis Y (FIG. 1): the shipping orientation, operation orientation, and a loading orientation. During transport or shipping, the treating chemistry cartridge 148 is configured in the shipping orientation, where the treating chemistry cartridge 148 is parallel with respect to the vertical axis Y (FIG. 1). In the shipping orientation, the one-way valve 166 is closed to prevent liquid treating chemistry from escaping or leaking from the treating chemistry cartridge 148. The two-way vent 168 can permit the flow of gas in and out of the gas portion 164 through the straw 172 within the interior volume 159, this bi-directional flow of gas can prevent gas product from building up within the body 158 of treating chemistry cartridge 148, subsequently preventing cracks or other damage from causing leaks during transport.

During operation of the dishwasher 10, the treating chemistry cartridge 148 is configured in the use orientation. In the use orientation, the treating chemistry cartridge 148 is oriented the same as the shipping orientation with respect to the vertical axis Y (FIG. 1). However, the one-way valve 166 is open and fluidly coupled to the treating chemistry dispensing system 146 and the two-way vent 168 is fluidly coupled to ambient, which is fluidly coupled to the gas portion 164 via the straw 172. When the liquid treating chemistry is drawn out of treating chemistry cartridge 148 by the treating chemistry dispensing system 146, the volume of liquid treating chemistry drawn out can be replaced by air vented into the treating chemistry cartridge 148, by the two-way vent 168 with the straw 172 located within the interior volume 159.

Figure 5B:
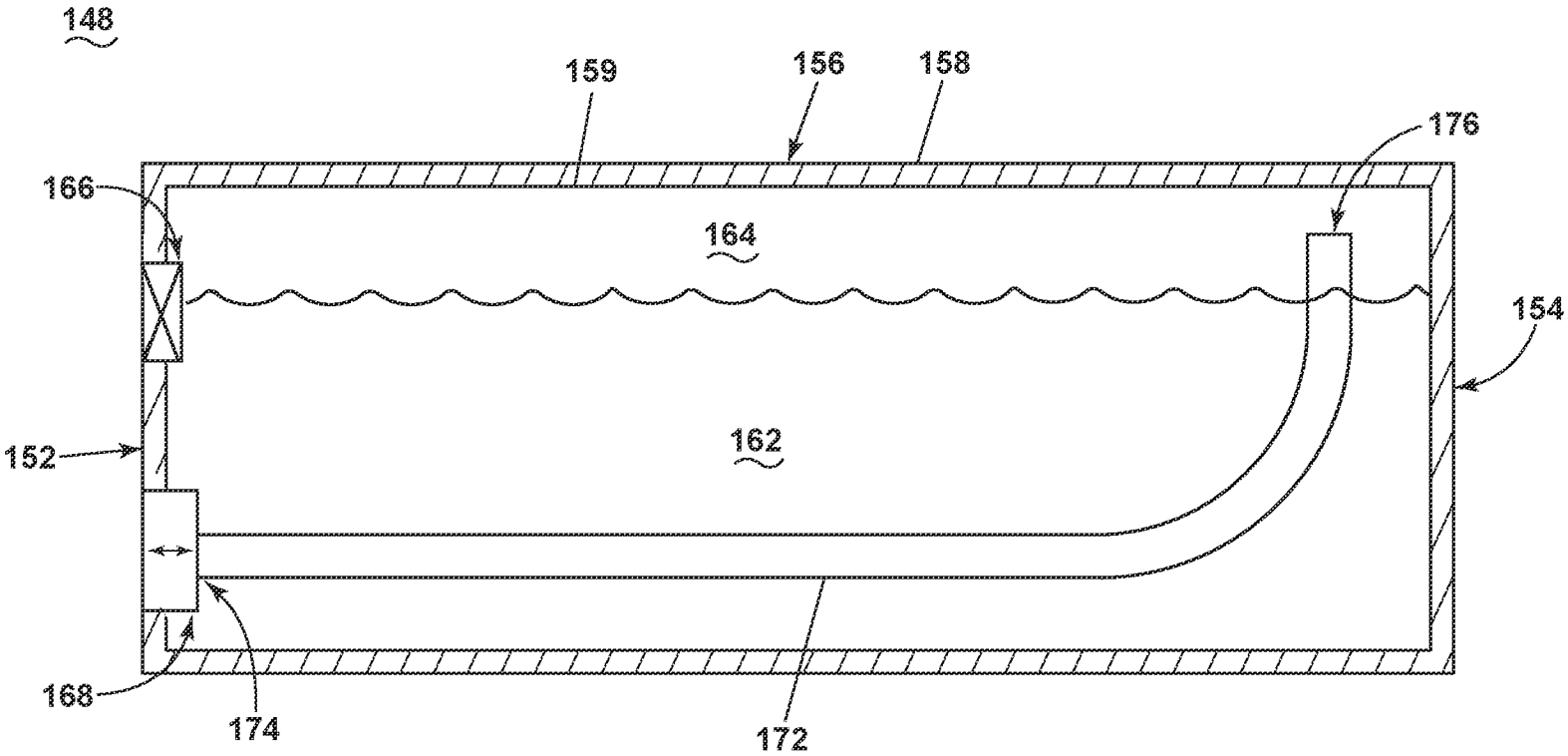
FIG. 5B is a schematic view of the treating chemistry cartridge in a loading orientation, according to a second embodiment.

FIG. 5B is a schematic view of the treating chemistry cartridge 148 in the loading orientation, which is oriented about 90 degrees different from the use orientation with respect to the vertical axis Y (FIG. 1), according to a second embodiment. During article loading, when the dishwasher 10 is loaded with articles for treatment, the door assembly 20 is open and the treating chemistry cartridge 148 is configured in the loading orientation, the one-way valve 166 is open and fluidly coupled to the treating chemistry dispensing system 146, and the two-way vent 168 is fluidly coupled to the first opening of the straw 172 and the second opening 176 is located in the gas portion 164. Further, the body 158 can be oriented at an angle corresponding to the angle in which the door assembly 20 is opened for article loading. The angle can be any degree between the vertical axis Y and the horizontal axis Z (FIG. 1).

Aspects of the disclosure provide for several benefits, including that the treating chemistry cartridge with the two-way vent can ventilate during transport, to prevent a build-up of product gas from cracking or otherwise damaging the body of the treating chemistry cartridge. Further, the one-way valve prevents leakage of treating chemistry, allowing the treating chemistry cartridge to be shipped or otherwise transported with treating chemistry within the interior volume.

Further yet, during operation the two-vent allows for the bi-direction flow of gas into and out of treating chemistry cartridge, when the liquid treating chemistry is drawn out of treating chemistry cartridge by the treating chemistry dispensing system, the volume of dispensed liquid treating chemistry is replaced by air vented into the treating chemistry cartridge, by the two-way vent with the straw.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A treating chemistry cartridge for use in a treating chemistry dispensing system of a household appliance, the treating chemistry cartridge comprising:

a non-collapsible body defining an interior volume having a liquid treating chemistry portion, for holding one or more liquid treating chemistries, and a gas portion, for holding a product gas from the one or more liquid treating chemistries;

a one-way valve provided in the non-collapsible body and fluidly coupled to the liquid treating chemistry portion; and a two-way vent provided in the non-collapsible body and fluidly coupled to the gas portion;

wherein the one-way valve and the two-way vent are located on the same side of the non-collapsible body.

2. The treating chemistry cartridge of claim 1, wherein the treating chemistry cartridge is configured for two orientations: a shipping orientation where the one-way valve is closed and the two-way vent permits a flow of gas in and out of the gas portion, without an escape of liquid treating chemistry; and a use orientation where the one-way valve is open and fluidly coupled to the treating chemistry dispensing system and the two-way vent is fluidly coupled to ambient.

3. The treating chemistry cartridge of claim 2, wherein in the shipping orientation and the use orientation, the non-collapsible body is oriented the same with respect to a vertical axis.

4. The treating chemistry cartridge of claim 2, wherein the treating chemistry cartridge is further configured for a third orientation: a loading orientation where the household appliance is loaded with articles for treatment and the one-way valve is open and fluidly coupled to the treating chemistry dispensing system and the two-way vent is fluidly coupled to ambient.

5. The treating chemistry cartridge of claim 4, wherein in the shipping orientation and the use orientation, the non-collapsible body is oriented the same with respect to a vertical axis, whereas in the loading orientation, the non-collapsible body is oriented at an angle with respect to the vertical axis.

6. The treating chemistry cartridge of claim 5, wherein the angle is of any degree between vertical and horizontal axis.

7. The treating chemistry cartridge of claim 1, wherein the non-collapsible body has a bottom wall and the one-way valve, and the two-way vent are located in the bottom wall.

8. The treating chemistry cartridge of claim 7, further comprising a straw located within the interior volume, and the straw further having a first opening connected to the two-way vent and a second opening located in the gas portion.

9. The treating chemistry cartridge of claim 8, wherein at least a portion of the straw between the first opening and the second opening passes through the liquid treating chemistry portion.

10. The treating chemistry cartridge of claim 9, further comprising a straw having a first opening and a second opening, with the first opening fluidly coupled to the two-way vent.

11. The treating chemistry cartridge of claim 10, wherein the second opening is fluidly coupled to the gas portion.

12. The treating chemistry cartridge of claim 11, wherein at least a portion of the straw between the first opening and the second opening passes through the liquid treating chemistry portion.

* * * * *